United States Patent [19]

Fjällström

[11] 4,333,773

[45] Jun. 8, 1982

[54] METHOD FOR INTERNAL WASHING OR CLEANING AND RINSING OR DRYING OF TUBULAR MATERIALS

[76] Inventor: Bengt Fjällström, Södra Kungsvägen 9, Tidaholm, Sweden

[21] Appl. No.: 190,097

[22] Filed: Sep. 23, 1980

[30] Foreign Application Priority Data

Jun. 19, 1980 [SE] Sweden ..... 80045651

[51] Int. Cl.[3] ..... B08B 9/00

[52] U.S. Cl. ..... 134/22 C; 134/24; 134/30

[58] Field of Search ..... 134/10, 24, 30, 22 R, 134/22 C, 166 C, 167 C, 168 C, 169 C, 22.1, 22.11, 22.12, 22.18

[56] References Cited

U.S. PATENT DOCUMENTS

| | | | |
|---|---|---|---|
| 1,672,286 | 6/1928 | Stringham et al. | 134/10 |
| 1,701,824 | 2/1929 | Robinson | 134/24 |
| 3,039,477 | 6/1962 | Harbo | 134/169 C |
| 3,067,756 | 12/1962 | Buggink, Sr. | 134/169 C |
| 3,313,311 | 4/1967 | Gilson | 134/10 |
| 3,536,081 | 10/1970 | Riess | 134/168 C |
| 3,537,897 | 11/1970 | Kington | 134/22 |

*Primary Examiner*—S. Leon Bashore, Jr.
*Assistant Examiner*—Michael L. Goldman
*Attorney, Agent, or Firm*—Wenderoth, Lind & Ponack

[57] ABSTRACT

The invention relates to a method for internal washing or cleaning and rinsing or drying of tubular materials.

Particularly the invention relates to a method for washing or cleaning of tubular materials when a washing or a cleaning medium is brought to circulate in a washing or a cleaning system. Furthermore a purification of the washing or cleaning medium and a rinsing or drying medium is effected in a tank for the washing or cleaning medium.

5 Claims, 1 Drawing Figure

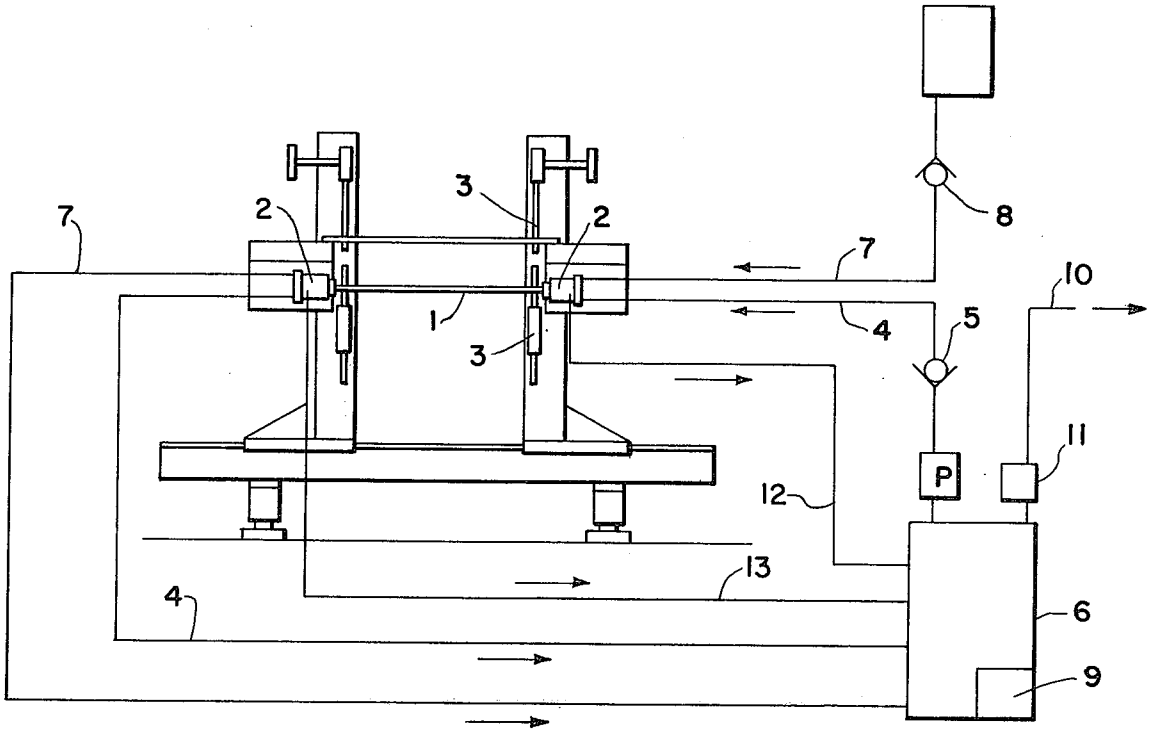
10
8
7
2
3
1
2
7
11
5
4
3
P
12
4
6
13
9

METHOD FOR INTERNAL WASHING OR CLEANING AND RINSING OR DRYING OF TUBULAR MATERIALS

BACKGROUND AND SUMMARY OF THE INVENTION

The invention relates to a method for the internal washing or cleaning and rinsing or drying of tubular materials. Particularly the invention relates to a method for washing or cleaning of tubular materials, when the washing or cleaning medium is brought to circulate in a washing or a cleaning system.

The method according the invention is not known in earlier techniques.

BRIEF DESCRIPTION OF THE DRAWING

The procedure for washing or cleaning and rinsing or drying of tubular materials is schematically shown in the single drawing FIGURE.

DETAILED DESCRIPTION OF THE INVENTION

In the drawing a tubular member 1 is intended to be cleaned or washed. The tube 1 is arranged between washing heads 2. A feeding device 3 is arranged adjacent to the heads 2 for feeding of new tubes 1 and for feeding out of washed or cleaned tubes 1. The washing heads are further, via conduits 4 and via a check valve 5 and a circulation pump P connected to a tank 6 for washing or cleaning medium in such a way that a pumping of for example a washing or a cleaning liquid is effected through the tube 1 and back to the tank 6, where it is purified.

A purifying device 9 is provided close to or in the tank 6 for purification of the washing or cleaning medium or liquid after it, preferably warmed up, has been pumped around in the system. The purification is preferably effected by means of a cyclone or filter purifier. The impurities are then gathered up in a special tank or in a space in the tank 6.

Conduits connect via a check valve 8, the one washing head 2 with a magazine or a tank for a rinsing or drying medium, preferably pressurized air, and the other washing head 2 with tank 6 in such a way that the rinsing or drying medium can be pumped through the tube 1 and into the tank 6, where it is purified from the remainder of the washing or cleaning liquid.

When drying, which preferably is effected by means of pressurized air, the pressurized air flows through the conduit 7 from for example a compressor via the check valve 8 and the tube 1 and the washing heads 2 and into the tank 6, where the air is purified from the remainder of the washing or cleaning liquid, whereby the pressurized air passes through a separation device 11 for remaining condensate, which condensate flows back to the tank 6, and whereby the air flows out through a ventilator tube 10.

The washing heads 2 are further connected directly with the tank 6 via draining conduits 12 and 13, whereby the washing heads 2 are provided with a system of channels for a rapid draining of the washing liquid.

The draining is effected during the rinsing or drying period. The draining conduits 12 and 13 can be blocked during the washing or cleaning period.

During the washing or cleaning period the washing liquid is pumped from the tank 6 via the check valve 5 into one washing head 2 and through the tube 1 and out the other washing head 2 and through a continuation of the conduit 7 into the tank 6, where the washing liquid is purified from impurities by means of the purifying device 9.

The washing heads 2 alternatively can be arranged for washing of tubular members with a shape other than the round one for example for a square tube or an end-formed tube with for example a conical shape.

The washing heads 2 may also be pivoted or arranged in the construction in such a way that a washing or cleaning of even bended tubes can be effected, whereby the tube ends might have any desired direction.

The method according the invention can be modified in several ways without departing the scope of the invention.

I claim:

1. A method for the internal washing or cleaning and the rinsing or drying of a tubular member, said process comprising:

connecting the opposite ends of a tubular member to be cleaned to a pair of washing heads;

providing a tank of washing or cleaning liquid having a purifying device;

during a washing or cleaning cycle, circulating in a closed system the washing or cleaning liquid from said tank, through one of said washing heads, said tubular member, the other of said washing heads, and back to said tank, thus cleaning the interior of said tubular member, passing the thus returned washing or cleaning liquid through said purifying device and thereby purifying said washing or cleaning liquid;

interrupting said washing or cleaning cycle and conducting a rinsing or drying cycle comprising passing a rinsing or drying gas from a source thereof through said one washing head, said tubular member, said other washing head, and into said tank, thereby rinsing or drying said interior of said tubular member, and separating said rinsing or drying gas from said washing or cleaning liquid in said tank; separating any remaining washing or cleaning liquid from said rinsing or drying gas comprising passing said gas from said tank through a separation device and therein condensing the remaining washing or cleaning liquid from said gas, flowing the thus condensed washing or cleaning liquid back to said tank, and discharging the thus purified gas through a discharge tube; and interrupting said rinsing or drying cycle and removing said tubular member from said washing heads.

2. A method as claimed in claim 1, wherein said rinsing or drying gas comprises compressed air.

3. A method as claimed in claim 1, further comprising, during said rinsing or drying cycle, draining said washing heads through drain lines directly to said tank.

4. A method as claimed in claim 1, wherein said tubular members have a configuration other than circular.

5. A method as claimed in claim 1, further comprising mounting said washing heads for connection to a said tubular member having a bent configuration.

* * * * *